US007927073B2

(12) United States Patent
Scott et al.

(10) Patent No.: US 7,927,073 B2
(45) Date of Patent: Apr. 19, 2011

(54) ADVANCED COOLING METHOD FOR COMBUSTION TURBINE AIRFOIL FILLETS

(75) Inventors: Robert Kenmer Scott, Geneva, FL (US); Alexander Ralph Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1024 days.

(21) Appl. No.: 11/649,573

(22) Filed: Jan. 4, 2007

(65) Prior Publication Data

US 2008/0166240 A1 Jul. 10, 2008

(51) Int. Cl.
*F01D 5/18* (2006.01)

(52) U.S. Cl. ..... 416/97 R; 416/193 A

(58) Field of Classification Search ..... 415/115; 416/96 A, 96 R, 97 A, 97 R, 193 A
See application file for complete search history.

(56) References Cited

U.S. PATENT DOCUMENTS 3,446,481 A * 5/1969 Kydd ..... 416/92
3,446,482 A * 5/1969 Kydd ..... 416/90 R
4,040,767 A * 8/1977 Dierberger et al. ..... 415/115
4,669,957 A 6/1987 Phillips et al.
4,672,727 A 6/1987 Field
5,098,257 A * 3/1992 Hultgren et al. ..... 415/115
5,122,033 A * 6/1992 Paul ..... 416/96 R
5,340,278 A 8/1994 Magowan
5,382,135 A 1/1995 Green
5,813,836 A 9/1998 Starkweather
5,864,949 A 2/1999 Kildea
6,099,251 A 8/2000 LaFleur
6,243,948 B1 6/2001 Lee et al.
6,341,939 B1 1/2002 Lee
6,354,797 B1 3/2002 Heyward et al.
6,375,415 B1 4/2002 Burdgick
6,379,118 B2 4/2002 Lutum et al.
6,431,833 B2 8/2002 Jones
6,478,540 B2 11/2002 Abuaf et al.
6,491,498 B1 12/2002 Seleski et al.
6,572,335 B2 6/2003 Kuwabara et al.
6,945,750 B2 9/2005 Benedetti et al.
6,981,846 B2 1/2006 Liang
6,991,430 B2 1/2006 Stec et al.
7,097,417 B2 * 8/2006 Liang ..... 415/115
7,121,797 B2 * 10/2006 Negulescu et al. ..... 416/97 R
7,131,817 B2 * 11/2006 Keith et al. ..... 416/97 R

* cited by examiner

*Primary Examiner* — Edward Look
*Assistant Examiner* — Sean J Younger

(57) ABSTRACT

The present invention is directed to a hollow turbine airfoil having a cooling system designed to provide enhanced cooling to the fillet of a turbine airfoil. The turbine airfoil may include at least one fillet cooling channel, passing proximate to the fillet. A portion of the fillet cooling channel may be positioned proximate to the fillet outer surface without breaching an outer surface of the turbine airfoil. The turbine airfoil may include a vortex plate positioned adjacent to the end wall inner surface proximate to the fillet and an opening of the fillet cooling channel may be in fluid communication with the vortex chamber. The turbine airfoil may also include at least one end wall film cooling channel that may extend obliquely through the end wall and may be in fluid communication with the vortex chamber.

18 Claims, 10 Drawing Sheets

ADVANCED COOLING METHOD FOR COMBUSTION TURBINE AIRFOIL FILLETS

FIELD OF THE INVENTION

The present invention is directed generally to cooling turbine components of gas turbine systems, and more particularly to cooling a fillet between an end wall and an airfoil in a gas turbine blade or vane.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade and vane assemblies to these high temperatures. As a result, turbine rotating blades and turbine stationary vanes (hereafter "turbine airfoils") must be made of materials capable of withstanding such high temperatures. In addition, turbine airfoils often contain cooling systems for prolonging the life of the turbine airfoils and reducing the likelihood of failure as a result of excessive temperatures.

Typically, turbine blades are formed from a root portion and a platform, or end wall, at one end and a generally elongated airfoil forming a blade that extends radially outward from the end wall. The blade is ordinarily composed of a tip opposite the root section, a leading edge, a trailing edge, a pressure side wall and a suction side wall. A turbine blade typically includes a fillet on the outer surface of the blade along the intersection of the generally elongated airfoil and the end walls. The inner aspects of most turbine blades contain an intricate maze of cooling channels forming a cooling system. The cooling channels in the blades may receive air from the compressor of the turbine engine and pass the air through the airfoil.

Turbine vanes are formed from a generally elongated airfoil, having a first end wall on one end and a second end wall on the opposite end of the airfoil. The airfoil itself generally has a leading edge, a trailing edge, a pressure side wall and a suction side wall. The elongated portion of the vane extends radially between the first end wall and the second end wall. A turbine vane may include a first fillet along the intersection of the generally elongated airfoil and the first end wall, and a second fillet along the intersection of the generally elongated airfoil and the second end wall. Much like blades, the inner aspects of most turbine vanes contain cooling channels forming a cooling system.

The cooling channels often include multiple flow paths that are designed to maintain the turbine airfoil at a relatively uniform temperature. However, localized hot spots may form where parts of the turbine airfoil are not adequately cooled. These localized hot spots may damage the turbine airfoil and may eventually necessitate replacement of the turbine airfoil.

One area of a turbine airfoil that is particularly difficult to cool is the fillet at the intersection between the generally elongated airfoil and the end wall. Such difficulty cooling fillets is a result of several factors. First, in order to handle high localized stress, the fillet is generally thicker than adjacent turbine airfoil components. Thus, conventional impingement cooling and convection cooling of the inner surface of the generally elongated airfoil or end plate is less effective for cooling the fillet region. Second, due to the high local Stresses, convection cooling holes that penetrate the outer surface of the fillet are not desirable because such holes may concentrate the local stresses thereby significantly reducing the useful life of the turbine airfoil. Finally, film cooling along the outer surface of the fillet generally provides only limited cooling to the fillet because the horseshoe vortex may sweep the film away from the fillet or the film has mixed with hot gases prior to reaching the fillet thereby substantially reducing the film's effectiveness. Thus, a need exists for providing effective direct cooling of blade fillets and vane fillets without reducing the useful life of the blades or vanes.

SUMMARY OF THE INVENTION

The present invention is directed to a cooling system that provides direct cooling to a fillet portion of a turbine airfoil at an intersection between the generally elongated airfoil and an end wall. The fillet cooling system effectively cools the large body mass typically found at the intersection between the generally elongated airfoil and the end wall by passing cooling fluid through fillet cooling channels positioned within close proximity to the outer surfaces of the airfoil. The fillet cooling system may also include one or more impingement plates positioned proximate to an inner surface of the side wall outer surface for increasing the cooling ability of the cooling system. The fillet cooling system may also include one or more vortex chambers for increasing the effectiveness of the cooling system. The fillet cooling system may also include one or more end wall film cooling channels.

The turbine airfoil may include a generally elongated airfoil having a leading edge, a trailing edge, a pressure side wall and a suction side wall, and an end wall extending generally orthogonal to the generally elongated airfoil and proximate an end of the generally elongated airfoil. The turbine airfoil may have an internal cooling system formed from at least one cooling cavity in the turbine airfoil.

The turbine airfoil may include at least one fillet cooling channel, passing proximate to the intersection between a side wall and the end wall. The fillet cooling channel may be positioned such that a first opening of the at least one fillet cooling channel is situated on an inner surface of the side wall, and a second opening of the at least one fillet cooling channel may be situated on the inner surface of the end wall. A portion of the fillet cooling channel may be positioned proximate to the intersection between the generally elongated airfoil and the end wall without breaching an outer surface of the turbine airfoil. The airfoil may include a fillet on the outer surface of the turbine airfoil that extends along the intersection between the generally elongated airfoil and the end wall.

The turbine airfoil may include a first impingement plate that may be positioned within the internal cooling system proximate to an inner surface of the end wall. This arrangement may form a first impingement plate cavity between the inner surface of the end wall and the first impingement plate.

The airfoil cooling system may include a second impingement plate. The second impingement plate may be positioned generally along the inner surface of the side wall. The airfoil cooling system may also include a closure plug attached to the inner surface of the side wall and located proximate to the end of the second impingement plate closest to the end wall. This arrangement may form a second impingement cavity between the inner surface of the side wall, the second impingement plate and the closure plug. The closure plug may be positioned on the side wall such that the end of the side wall proximate the end wall and the closure plug are on opposite sides of the first opening of a fillet cooling channel on the inner surface of the side wall.

The turbine airfoil may include a vortex plate positioned proximate to an end of the end wall proximate the side wall, whereby a vortex chamber may be formed proximate to the inner surface of the end wall and the vortex plate. The second opening of the at least one fillet cooling channel may be in fluid communication with the vortex chamber. The vortex plate may include at least one vortex orifice in fluid communication with the first impingement plate cavity.

The turbine airfoil may also include one or more end wall film cooling channels that extend obliquely relative to the end wall. An end wall film cooling channel may be positioned such that a first opening of the end wall film cooling channel may be situated on an inner surface of the end wall, and a second opening of the end wall film cooling channel may be situated on an outer surface of the end wall. The first opening of the end wall film cooling channel may be in fluid communication with the vortex chamber. The end wall film cooling channels may be offset from the fillet cooling channels such that none of the end wall film cooling channels intersect with any of the at least one fillet cooling channels.

In addition to the vortex plate, the cooling system may include a second impingement plate. The second impingement plate may be positioned generally along the inner surface of the side wall. A closure plug may be attached to the inner surface of the side wall and proximate to the end of the second impingement plate closest to the end wall, thereby forming a second impingement cavity between the inner surface of the side wall, the second impingement plate and the closure plug. Finally, the closure plug may be positioned on the side wall such that the end of the side wall proximate the end wall and the closure plug are on opposite sides of the first opening of the at least one fillet cooling channel on the inner surface of the side wall.

An advantage of this invention is that it provides direct convection cooling to the airfoil fillet region without creating areas of concentrated local stress and reducing the useful life of the airfoil. Another advantage of the invention is that it provides a cooling method that delivers impingement cooling, vortex cooling, or both, to the fillet region. Yet another advantage of the invention is that it provides an integrated fillet cooling system that provides both direct convection cooling of the fillet region without reducing the useful life of the airfoil combined with impingement cooling, vortex cooling, or both, to the fillet region.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

FIG. 9A shows a fillet cooling channel with a theta ($\theta$) greater than 45 degrees. 9B shows the same cross-sectional view with a fillet cooling channel with a theta ($\theta$) less than 45 degrees.

DETAILED DESCRIPTION OF THE INVENTION

Figure 1:
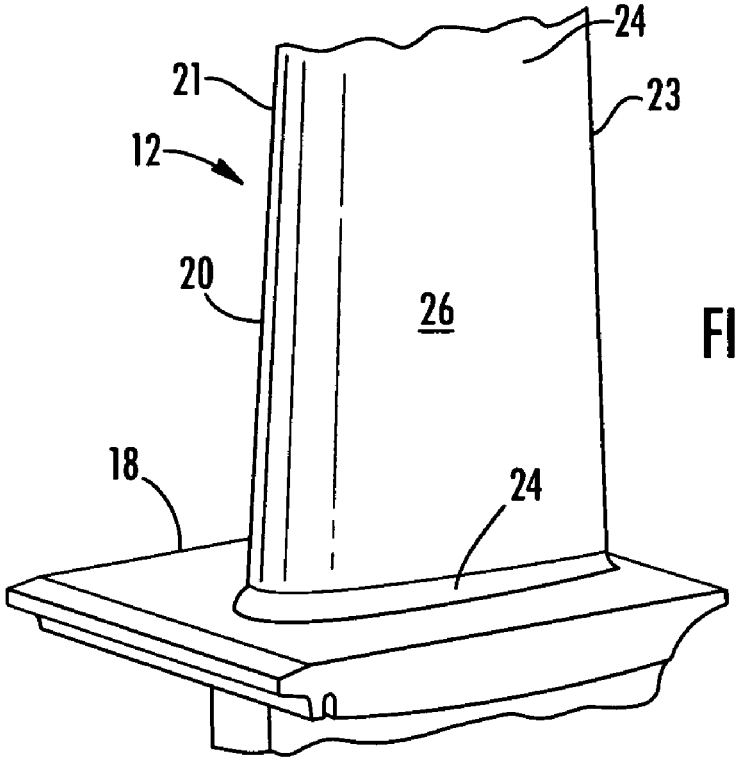
FIG. 1 is a perspective view of the radially inward region of a turbine vane containing a cooling system of the present invention.
Figure 2:
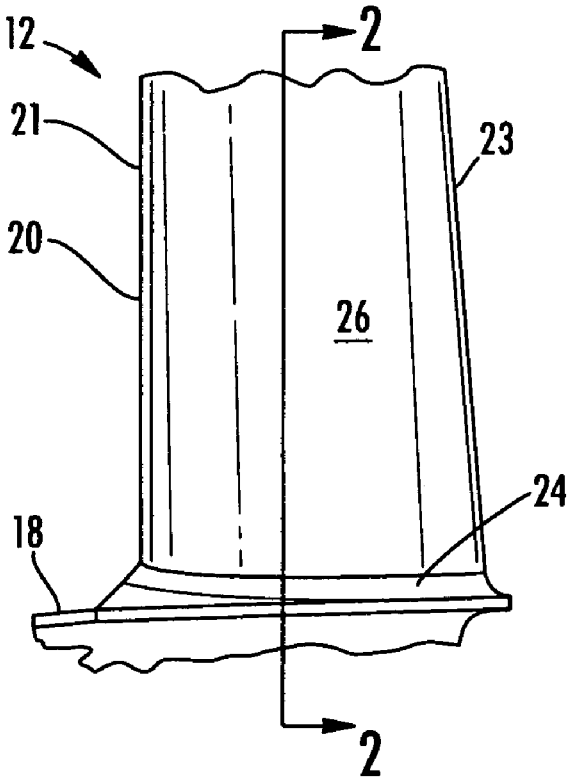
FIG. 2 is a side view of the turbine vane of FIG. 1.

This invention is directed to a turbine airfoil 12 that includes a fillet cooling system 17 designed to provide direct cooling to the fillet 24. Although the fillet 24 of a turbine vane 12 is used to illustrate the present invention, it should be understood that the invention applies equally to fillets 24 of turbine blades 12. In order to make application of the present invention to blades more apparent, where possible the detailed description uses terminology that may be applied to turbine airfoils 12, whether a blade 12 or a vane 12.

FIGS. 1 through 12 show the radially inward half of a turbine airfoil 12, a turbine vane 12 in this instance. A turbine airfoil 12 may be formed from a generally elongated airfoil 20 coupled at one end to an end wall 18. The turbine airfoil 12 may have a leading edge 21 and a trailing edge 23. The generally elongated airfoil 20 may be formed from a generally concave shaped portion forming a pressure side wall 26 and may have a generally convex shaped portion forming a suction side wall 28. The pressure side wall 26 and suction side wall 28 may be adapted for use in a turbine engine (not shown), for example, in a first stage of an axial flow turbine engine or other stage (not shown). A fillet 24 may be positioned at the intersection of the generally elongated airfoil 20 and the end wall 18. As shown in FIGS. 3-11, a cooling cavity 14 may be positioned in the turbine airfoil 12 for directing one or more gases through the turbine airfoil 12. The internal cooling system designed to cool the entire turbine airfoil 12 may operate by directing one or more cooling fluids, for instance air, through the turbine airfoil 12 from a compressor (not shown). The cooling cavity 14 is not limited to a particular shape, size, or configuration. Rather, the cooling cavity 14 may have any appropriate configuration.

Each side wall 26, 28 may have a side wall inner surface 43 and a side wall outer surface 44. Similarly, each end wall 18 may have an end wall inner surface 30 and an end wall outer surface 42. The fillet 24 may have a fillet outer surface 46.

Figure 3:
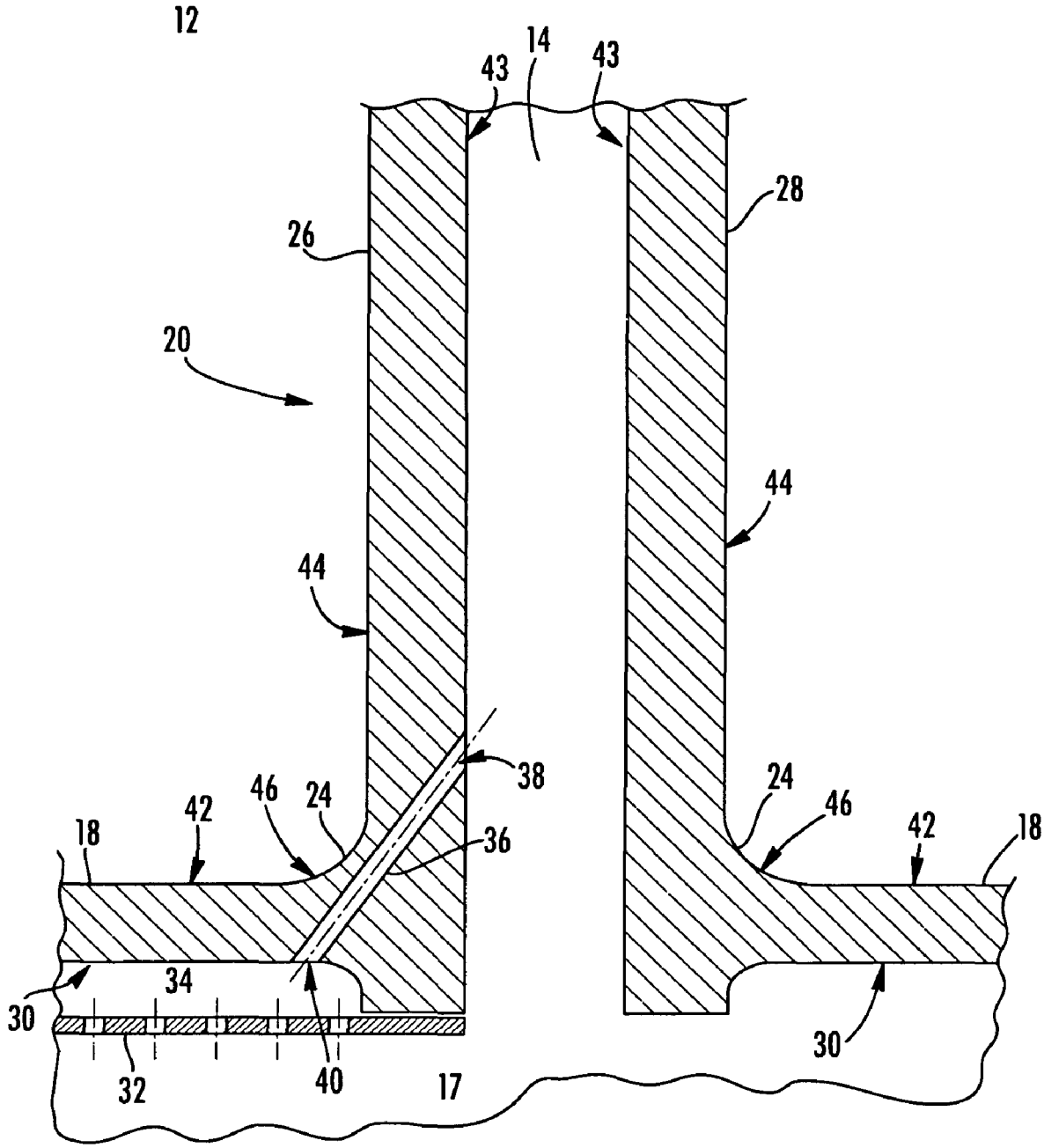
FIG. 3 is a partial cross-sectional view of the turbine vane of FIG. 2, taken along section line 2-2, that shows a turbine airfoil having a fillet cooling channel and a first impingement cavity.

FIG. 3 depicts a turbine airfoil 12 that includes the fillet cooling system 17. The turbine end wall 18 may include a first impingement plate 32 positioned within the cooling cavity 14 proximate to an end wall inner surface 30, thereby creating a first impingement plate cavity 34.

The turbine airfoil 12 may also include a fillet cooling channel 36, having a first fillet cooling channel opening 38 situated in a side wall inner surface 43 and a second fillet cooling channel opening 40 situated in an end wall inner surface 30. The fillet cooling channel 36 may pass proximate to the fillet 24 yet not breach an outer surface 42, 44, 46 of the turbine airfoil 12.

Figure 4:
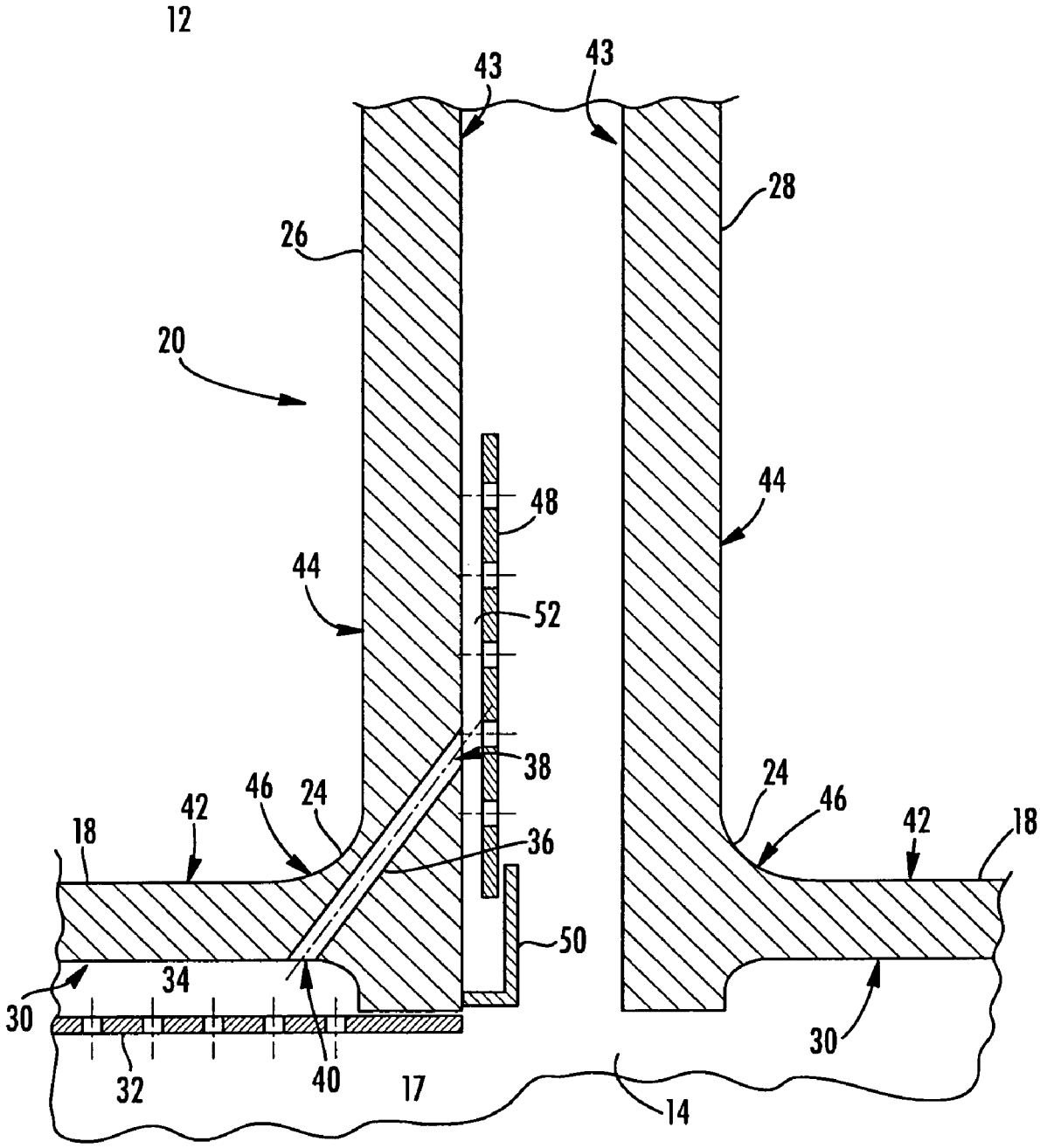
FIG. 4 is a partial cross-sectional view of the turbine vane of FIG. 2, taken along section line 2-2, that shows a turbine airfoil having a fillet cooling channel, a first impingement cavity, and a second impingement cavity.
Figure 5:
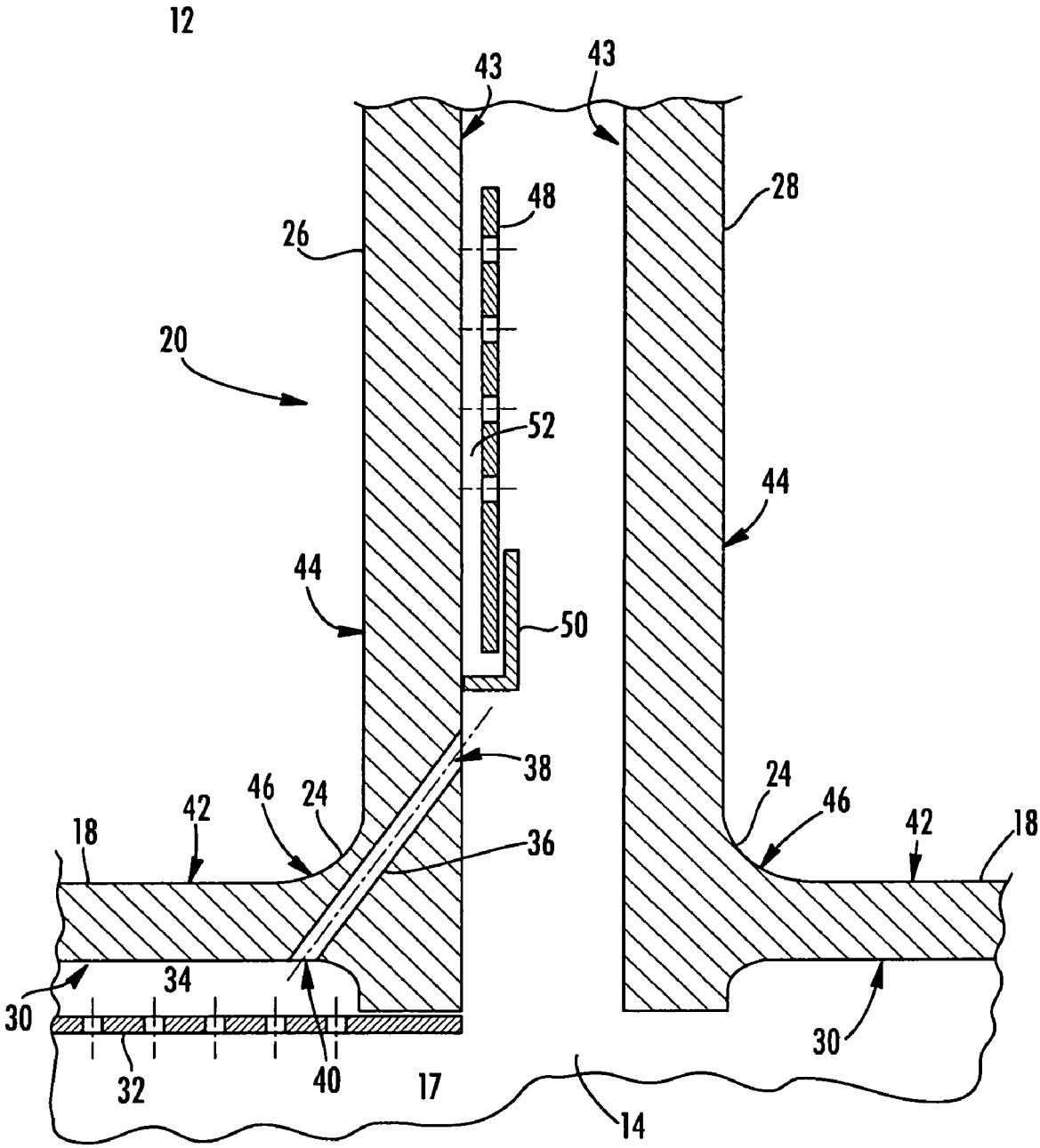
FIG. 5 is a partial cross-sectional view of the turbine vane of FIG. 2, taken along section line 2-2, that shows a turbine airfoil having a fillet cooling channel, a first impingement cavity, and a second impingement cavity located radially outward of the adjacent fillet cooling channel opening.

As shown in FIG. 4, the turbine airfoil 12 may also include a second impingement plate 48 positioned proximate the side wall inner surface 43. A closure plug 50 may be attached to a side wall inner surface 43 proximate an end of the second impingement plate 48 nearest to the end wall 18. In this configuration, a second impingement plate cavity 52 may be defined by the side wall inner surface 43, the second impingement plate 48, and the closure plug 50. As shown in FIG. 5, the closure plug 50 may be positioned such that the closure plug 50 and the end of the side wall 26, 28 proximate the end wall 18 are on opposite sides of the first fillet cooling channel opening 38.

A cooling fluid may flow from a first fillet cooling channel opening 38 to a second fillet cooling channel opening 40 and may provide convection cooling directly to the fillet 24. As shown in FIGS. 3-12, the fillet cooling channel 36 may allow cooling fluid to pass through the fillet 24 and deliver direct cooling unlike convection cooling of the side wall inner surface 43 or the end wall inner surface 30. Because the fillet cooling channel 36 does not breach the outer surface 42, 44, 46 of the turbine airfoil 12, the fillet cooling channel 36 may deliver superior cooling without significantly reducing the useful life of the turbine airfoil 12.

Figure 9A:
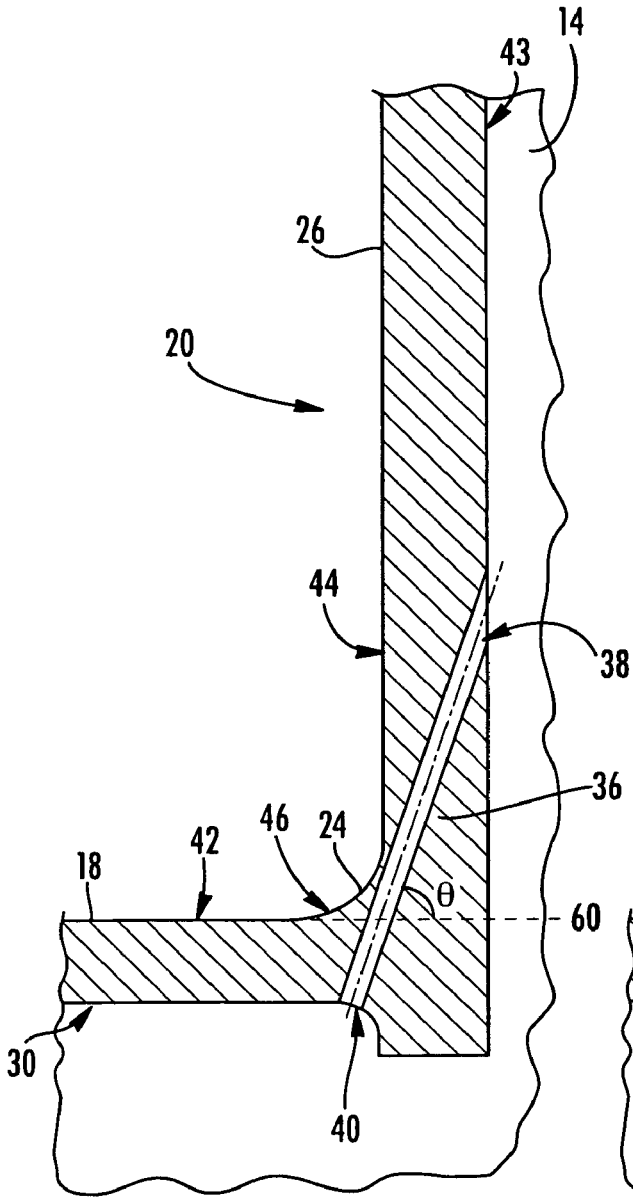
FIGS. 9A and 9B are partial cross-sectional views of the cooling system of the turbine vane of FIG. 2, taken along section line 2-2, that shows a few of the possible fillet cooling channel angles.
Figure 9B:
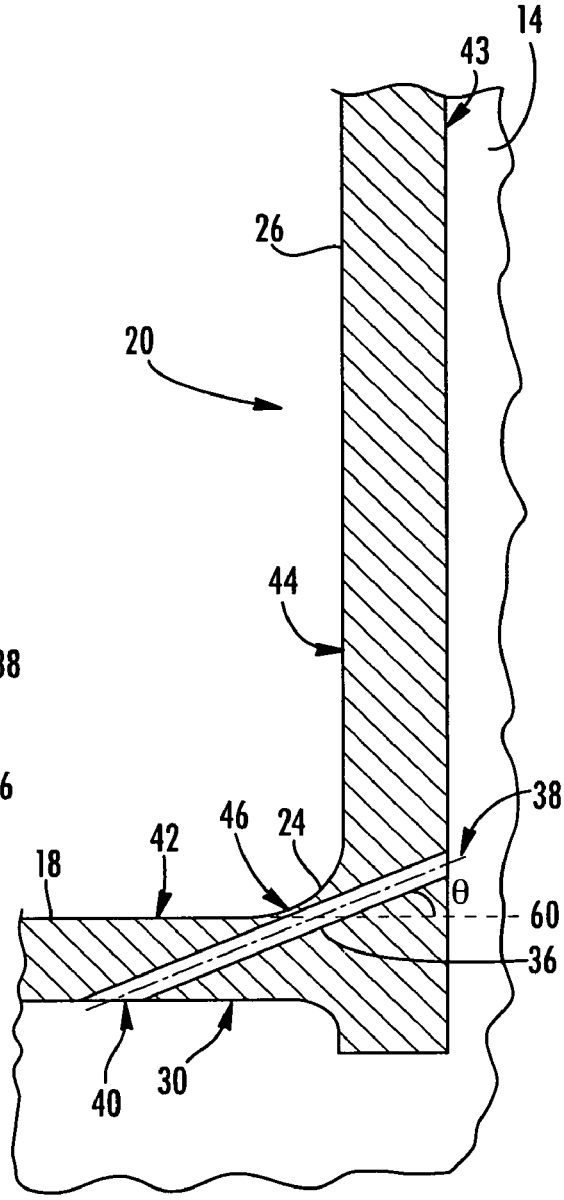

There are many possible configurations and orientations for the at least one fillet cooling channels 36. For instance, the number of fillet cooling channels 36, the spacing of the fillet cooling channels 36, the diameter of the fillet cooling channels 36, and the angle, hereafter angle theta (θ), between the fillet cooling channel 36 with respect to an axis 60 defined by the end plate outer surface 42, are all variables that may be adjusted to deliver the desired level of cooling to the fillet 24. As shown in FIG. 9, angle theta (θ) may range between 0 and 90 degrees, however, in one embodiment, angle theta may be between 5 and 85 degrees.

Another variable for the fillet cooling channels 36 is the pressure difference between the first fillet cooling channel opening 38 and the second fillet cooling channel opening 40. Depending on the relative pressure difference, cooling fluid may flow from the first fillet cooling channel opening 38 to the second fillet cooling channel opening 40 or vice versa. The pressure difference at each opening 38, 40 of a fillet cooling channel 36 may be controlled by a number of means including, but not limited to, use of an impingement plate 32, 48, use of a vortex plate 54, perforation density in an impingement plate 32, 48 or vortex plate 54, the fluid supply pressure in a cavity 14, 34, 52, 56 adjacent to each fillet cooling opening 38, 40, the number and size of fillet cooling holes 36, and the number and size of end wall film cooling channels 62.

Figure 6:
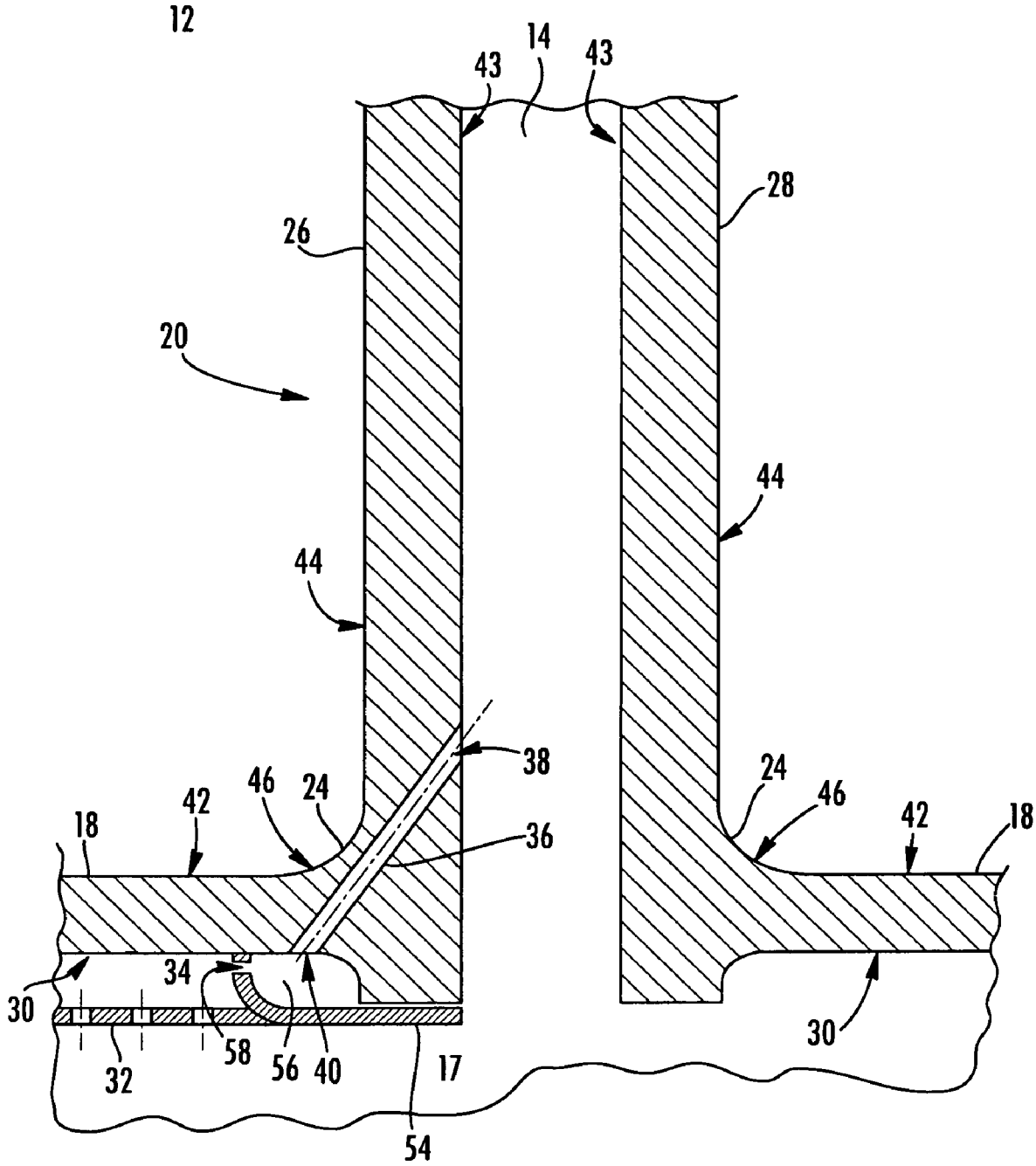
FIG. 6 is a partial cross-sectional view of the turbine vane of FIG. 2, taken along section line 2-2, that shows a turbine airfoil having a fillet cooling channel, a first impingement cavity, and a vortex chamber.

Referring now to FIG. 6, the turbine airfoil 12 may include a vortex plate 54 positioned proximate the end of the first impingement plate 32 proximate to a side wall 26, 28. A vortex chamber 56 may be formed proximate to the end wall inner surface 30 and the vortex plate 54. The second fillet cooling channel opening 40 may be in fluid communication with the vortex chamber 56. The vortex plate 54 may include at least one vortex orifice 58 in fluid communication with the first impingement plate cavity 34.

The vortex chamber 56 may utilize cooling fluid traveling between a second fillet cooling channel opening 40 and a vortex orifice 58 or an end wall film cooling channel 62 to create a high velocity vortex proximate to the end wall inner surface 30 nearest the fillet 24. This high velocity, vortex of cooling fluids may have a higher heat transfer coefficient than cooling fluid used in convection cooling or impingement cooling. Thus, the vortex chamber 56 may provide better cooling of the airfoil 12, such as the end wall inner surface 30 and the fillet 24, than conventional cooling methods.

Figure 7:
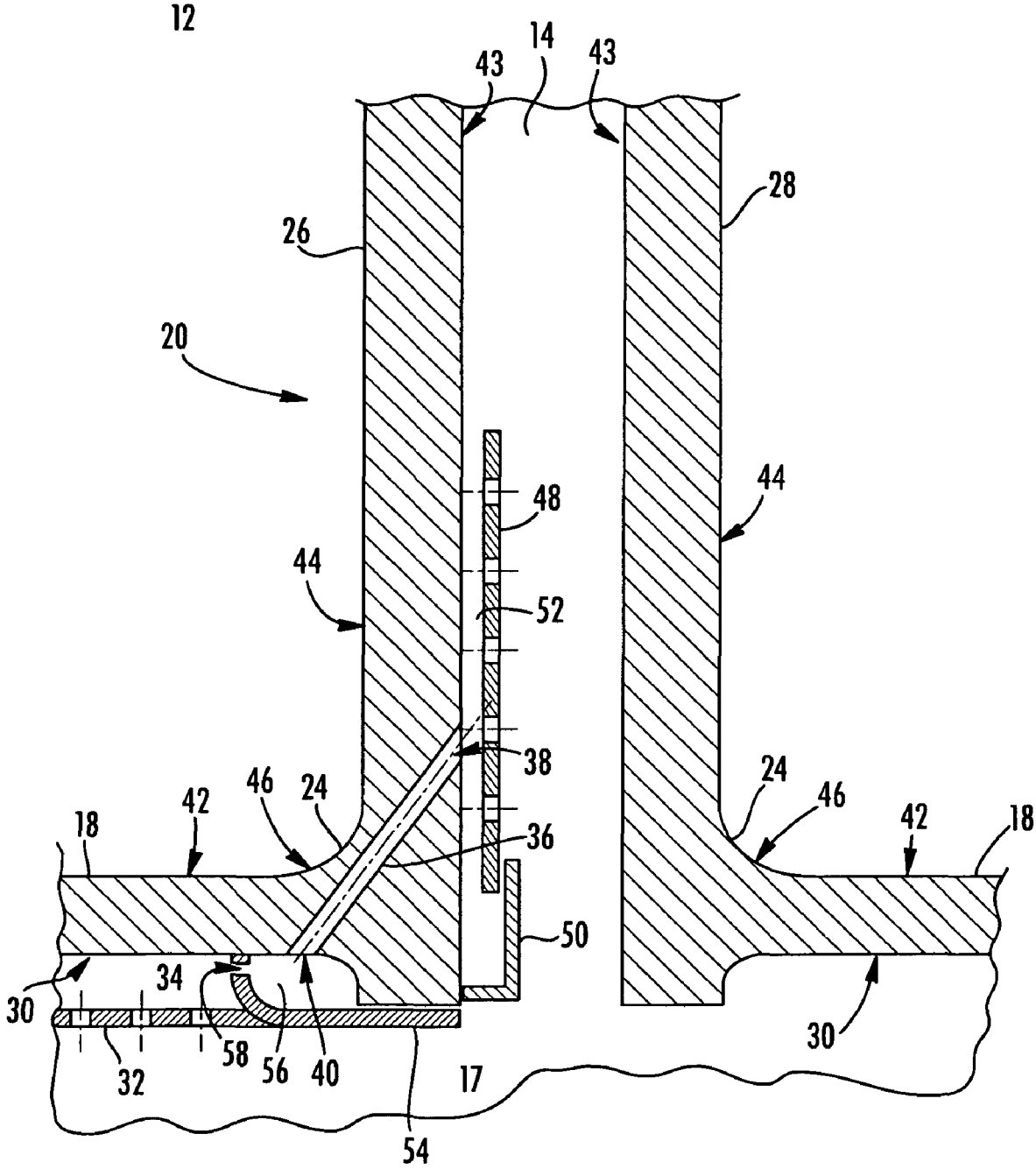
FIG. 7 is a partial cross-sectional view of the turbine vane of FIG. 2, taken along section line 2-2, that shows a turbine airfoil having a fillet cooling channel, a first impingement cavity, a vortex chamber, and a second impingement cavity.
Figure 8:
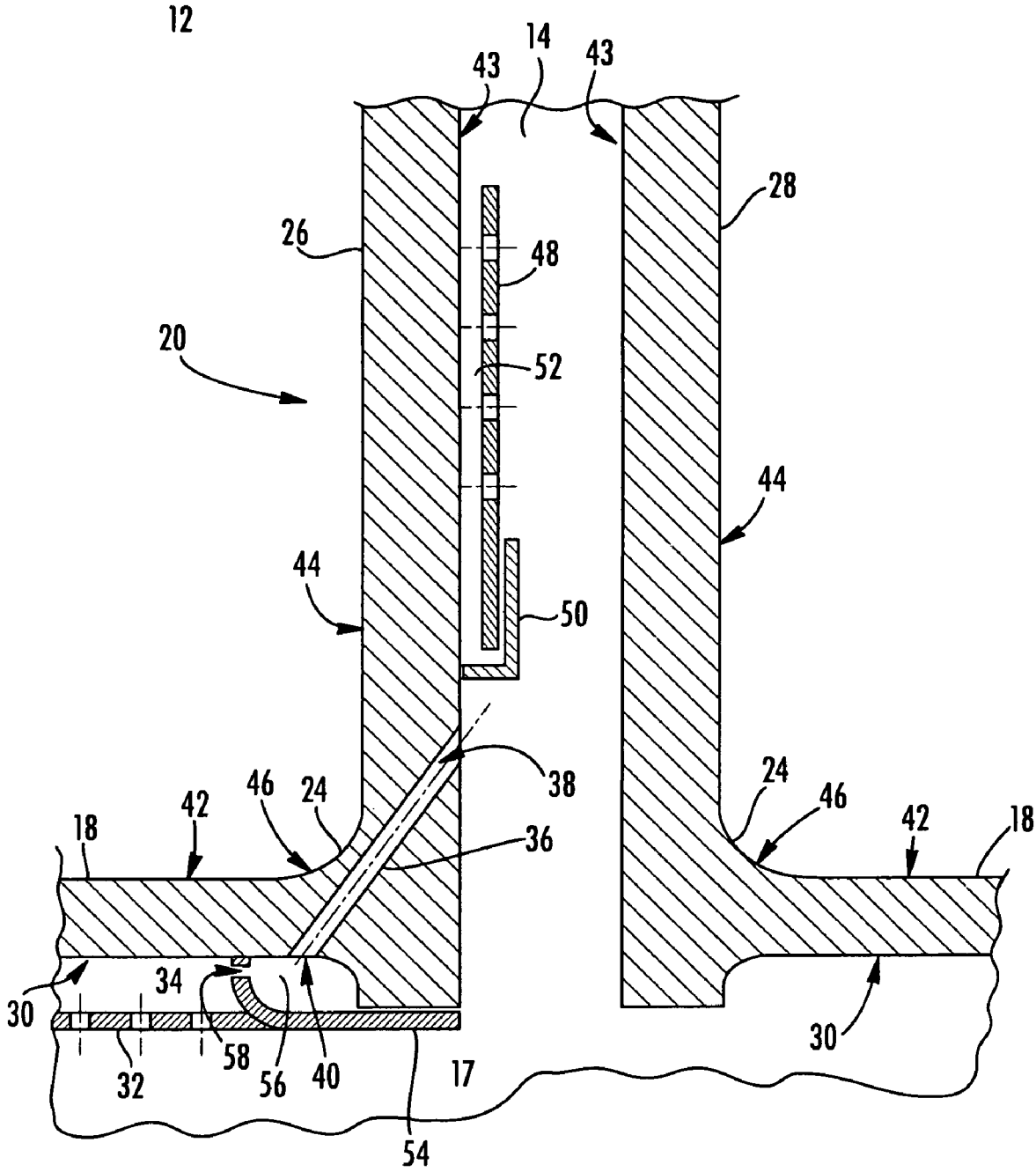
FIG. 8 is a partial cross-sectional view of the turbine vane of FIG. 2, taken along section line 2-2, that shows a turbine airfoil having a fillet cooling channel, a first impingement cavity, a vortex chamber, and a second impingement cavity located radially outward of the adjacent fillet cooling channel opening.

As shown in FIG. 7, a turbine airfoil 12 with a vortex plate 54 may include a second impingement plate 48 positioned proximate the side wall inner surface 43. A closure plug 50 may be attached to a side wall inner surface 43 proximate an end of the second impingement plate 48 closest to the end wall 18. A second impingement plate cavity 52 may be defined by the side wall inner surface 43, the second impingement plate 48, and the closure plug 50. As shown in FIG. 8, the closure plug 50 may be located such that the end of the side wall 26, 28 proximate the end wall 18 and the closure plug 50 are on opposite sides of the first fillet cooling channel opening 38.

Figure 10:
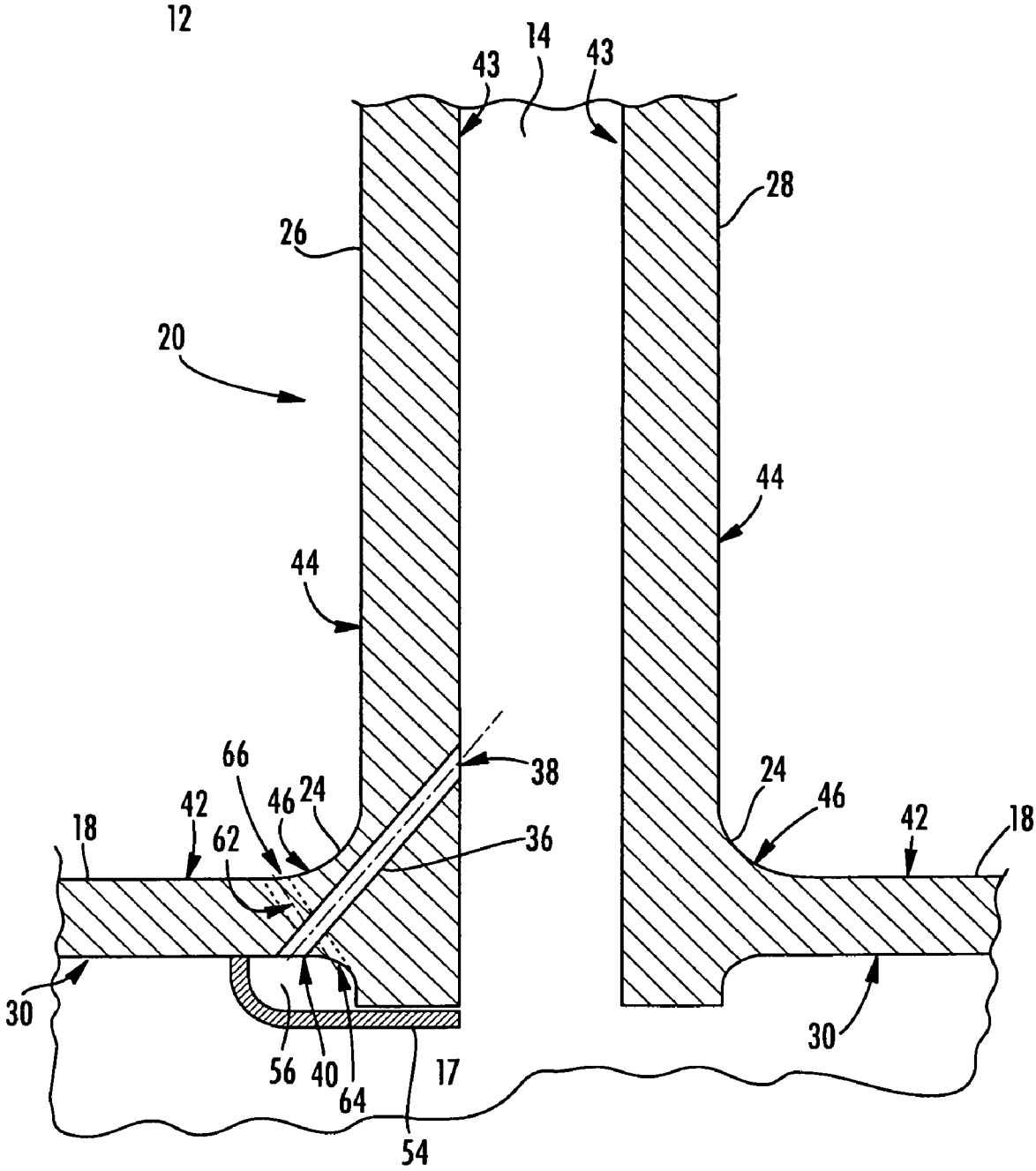
FIG. 10 is a partial cross-sectional view of the turbine vane of FIG. 2, taken along section line 2-2, that shows a turbine airfoil having a fillet cooling channel, a vortex chamber, and an end wall film cooling channel.
Figure 11:
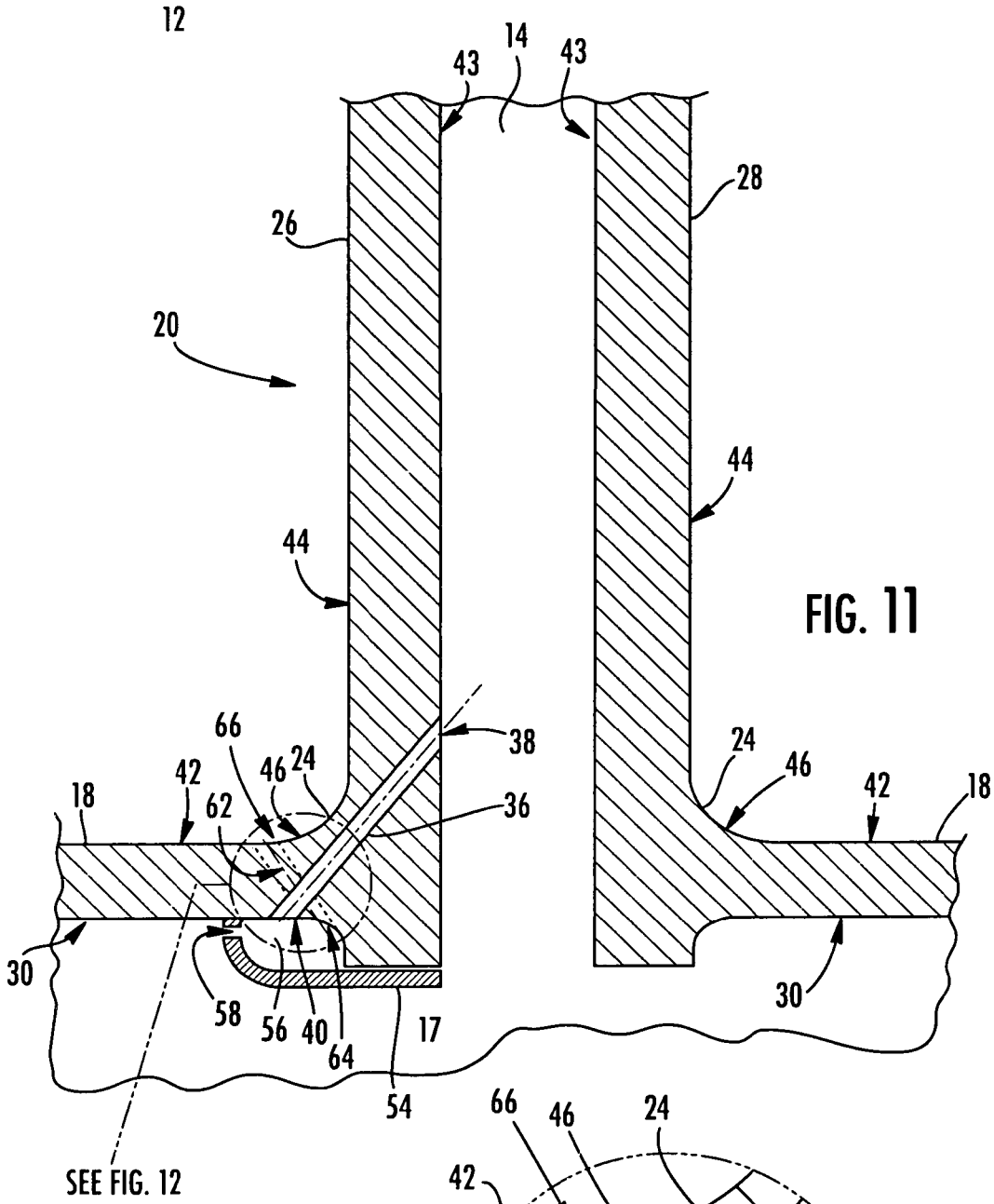
FIG. 11 is a partial cross-sectional view of the turbine vane of FIG. 2, taken along section line 2-2, that shows a turbine airfoil having a fillet cooling channel, a vortex chamber with a vortex orifice, and an end wall film cooling channel.
Figure 12:
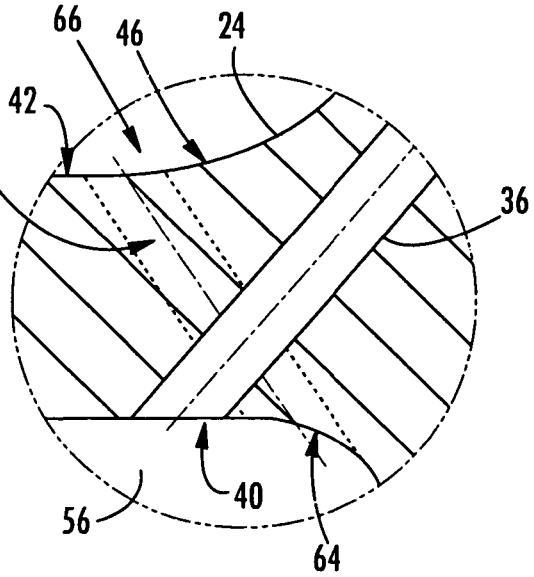
FIG. 12 is a detail view of FIG. 11 that shows turbine airfoil components surrounding the vortex chamber.

The turbine airfoil 12 may also include at least one end wall film cooling channel 62, that extends obliquely relative to the end wall 18, as shown in FIGS. 10-12. The end wall film cooling channel 62 may be positioned such that a first end wall film cooling channel opening 64 is situated on an end wall inner surface 30, and a second end wall film cooling channel opening 66 may be situated on an end wall outer surface 42. The first end wall film cooling channel opening 64 may be in fluid communication with the vortex chamber 56. The end wall film cooling channels 62 may be offset from the fillet cooling channels 36 such that none of the end wall film cooling channels 62 intersect with any of the fillet cooling channels 36. As shown in FIGS. 11-12, the vortex plate 54 may include one or more vortex orifice 58 in fluid communication with the cooling cavity 14.

The end wall film cooling channels 62 may be used to exhaust cooling fluid from the vortex chamber 56. The end wall film cooling channels 62 may also provide convection cooling to the fillet 24 by cooling adjacent portions of the end wall 18 and film cooling to the end wall outer surface 42.

The characteristics of a vortex formed within the vortex chamber 56 may be dependent on a number of factors. For instance the size, spacing, and location of the one or more vortex orifices 58 may have a significant impact on the pressure within the vortex chamber 56 and the flow of cooling fluid within the vortex chamber 56. Other variables include the size, spacing, location and angle theta (θ) of the fillet cooling channels 36 in fluid communication with the vortex chamber 56. Yet other variables include the size, spacing, location and angle of the end wall film cooling channels 62 in fluid communication with the vortex chamber 56.

The efficiency of the vortex cooling may also be improved by creating additional turbulence within the vortex chamber 56 by adding texture to the end wall inner surface 30, the vortex plate 54, or other surfaces in thermal communication with the fillet 24. Additional cooling of the fillet 24 may also be achieved by increasing the surface area of the end wall inner surface 30, the vortex plate 54, or other surfaces in thermal communication with the fillet 24. Texture and additional surface area may be created by including surface features including, but not limited to, surface roughness, ribs, or pedestals on a surface of a portion of a surface 30, 54 defining the vortex chamber 56 that is in thermal communication with the fillet 24.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated airfoil having a leading edge, a trailing edge, a pressure side wall and a suction side wall, an end wall extending generally orthogonal to the generally elongated airfoil and proximate an end of the generally elongated airfoil, and an internal cooling system formed from at least one cooling cavity in the turbine airfoil;

at least one fillet cooling channel, passing proximate to an intersection between one of the side walls and the end wall;

wherein a portion of the at least one fillet cooling channel is positioned proximate to the intersection between the one of the side walls and the end wall without breaching an outer surface of the turbine airfoil;

a first impingement plate positioned in the internal cooling system proximate to an inner surface of the end wall, wherein a first impingement plate cavity is formed between the inner surface of the end wall and the first impingement plate;

a second impingement plate positioned generally along the inner surface of the one of the side walls, wherein a second impingement plate cavity is formed between the inner surface of the one of the side walls and the second impingement plate, the at least one fillet cooling channel being positioned such that a first opening of the at least one fillet cooling channel is situated in an inner surface of the one of the side walls forming the second impingement plate cavity and such that a second opening of the at least one fillet cooling channel is situated in the inner surface of the end wall forming the first impingement plate cavity, whereby the first impingement plate cavity is in fluid communication with the second impingement plate cavity by the at least one fillet cooling channel; and a closure plug attached to the inner surface of the one of the side walls and proximate to an end of the second impingement plate closest to the end wall, thereby forming a second impingement cavity between the inner surface of the one of the side walls, the second impingement plate and the closure plug.

2. The turbine airfoil of claim 1, further comprising a fillet on the outer surface of the turbine airfoil that extends along the intersection between the generally elongated airfoil and the end wall.

3. The turbine airfoil of claim 1, wherein the closure plug is positioned on the one of the side walls such that the end of the one of the side walls proximate the end wall and the closure plug are on opposite sides of the first opening of the at least one fillet cooling channel in the inner surface of the one of the side walls.

4. A turbine airfoil, comprising:

a generally elongated airfoil having a leading edge, a trailing edge, a pressure side wall and a suction side wall, an end wall extending generally orthogonal to the generally elongated airfoil and proximate an end of the generally elongated airfoil, and an internal cooling system formed from at least one cooling cavity in the turbine airfoil;

at least one fillet cooling channel, passing proximate to an intersection between one of the side walls and the end wall, positioned such that a first opening of the at least one fillet cooling channel is situated in an inner surface of the one of the side walls and a second opening of the at least one fillet cooling channel is situated in the inner surface of the end wall; and wherein a portion of the at least one fillet cooling channel is positioned proximate to the intersection between the one of the side walls and the end wall without breaching an outer surface of the turbine airfoil; and a vortex plate positioned proximate to an end of the end wall proximate one of the side walls, wherein a vortex chamber is formed proximate to the inner surface of the end wall and the vortex plate.

5. The turbine airfoil of claim 4, wherein the second opening of the at least one fillet cooling channel is in fluid communication with the vortex chamber.

6. The turbine airfoil of claim 5, further comprising at least one end wall film cooling channel, extending obliquely relative to the end wall, positioned such that a first opening of the at least one end wall film cooling channel is situated on the inner surface of the end wall and a second opening of the at least one end wall film cooling channel is situated on an outer surface of the end wall.

7. The turbine airfoil of claim 6, wherein the vortex plate includes at least one vortex orifice in fluid communication with the at least one cooling cavity.

8. The turbine airfoil of claim 6, wherein the first opening of the at least one end wall film cooling channel is in fluid communication with the vortex chamber.

9. The turbine airfoil of claim 8, wherein the at least one end wall film cooling channels are offset from the at least one fillet cooling channels such that none of the at least one end wall film cooling channels intersect with any of the at least one fillet cooling channels.

10. The turbine airfoil of claim 8, wherein the cooling system further comprises a impingement plate, wherein the impingement plate is positioned generally along the inner surface of the one of the side walls.

11. The turbine airfoil of claim 10, further comprising a closure plug attached to the inner surface of the one of the side walls and proximate to an end of the impingement plate closest to the end wall, thereby forming an impingement cavity between the inner surface of the one of the side walls, the impingement plate and the closure plug.

12. The turbine airfoil of claim 11, wherein the closure plug is positioned on the one of the side walls such that the end of the one of the side walls proximate the end wall and the closure plug are on opposite sides of the first opening of the at least one fillet cooling channel in the inner surface of the one of the side walls.

13. The turbine airfoil of claim 8, wherein the vortex plate includes at least one vortex orifice in fluid communication with the at least one cooling cavity.

14. The turbine airfoil of claim 5, wherein the cooling system further comprises an impingement plate, wherein the impingement plate is positioned generally along the inner surface of the one of the side walls.

15. The turbine airfoil of claim 14, further comprising a closure plug attached to the inner surface of the one of the side walls and proximate to an end of the impingement plate closest to the end wall, thereby forming an impingement plate cavity between the inner surface of the one of the side walls, the impingement plate and the closure plug.

16. The turbine airfoil of claim 15, wherein the closure plug is positioned on the one of the side walls such that the end of the one of the side walls proximate the end wall and the closure plug are on opposite sides of the first opening of the at least one fillet cooling channel in the inner surface of the one of the side walls.

17. The turbine airfoil of claim 16, wherein the vortex plate includes at least one vortex orifice in fluid communication with an impingement plate cavity is formed between the inner surface of the end wall and the first impingement plate.

18. A turbine airfoil, comprising:

a generally elongated airfoil having a leading edge, a trailing edge, a pressure side wall and a suction side wall, an end wall extending generally orthogonal to the generally elongated airfoil and proximate an end of the generally elongated airfoil, and an internal cooling system formed from at least one cooling cavity in the turbine airfoil;

at least one fillet cooling channel, passing proximate to an intersection between one of the side walls and the end wall, positioned such that a first opening of the at least one fillet cooling channel is situated in an inner surface of the one of the side walls and a second opening of the at least one fillet cooling channel is situated in the inner surface of the end wall;

wherein a portion of the at least one fillet cooling channel is positioned proximate to the intersection between the one of the side walls and the end wall without breaching an outer surface of the turbine airfoil;

an impingement plate positioned generally along the inner surface of the one of the side walls of the generally elongated airfoil; and a closure plug attached to the inner surface of the one of the side walls and proximate to an end of the impingement plate, thereby forming an impingement cavity between the inner surface of the one of the side walls, the impingement plate and the closure plug.

* * * * *